US006983694B2

(12) United States Patent
Vermeersch et al.

(10) Patent No.: US 6,983,694 B2
(45) Date of Patent: Jan. 10, 2006

(54) NEGATIVE-WORKING THERMAL LITHOGRAPHIC PRINTING PLATE PRECURSOR COMPRISING A SMOOTH ALUMINUM SUPPORT

(75) Inventors: Joan Vermeersch, Deinze (BE); Dirk Kokkelenberg, Schoten (BE); Philip John Watkiss, Leeds (GB); Klaus Joerg, Ingelheim (DE)

(73) Assignee: AGFA Gevaert, Mortsel (BE)

( * ) Notice: Subject to any disclaimer, the term of this patent is extended or adjusted under 35 U.S.C. 154(b) by 0 days.

(21) Appl. No.: 10/421,162

(22) Filed: Apr. 23, 2003

(65) Prior Publication Data

US 2003/0200886 A1 Oct. 30, 2003

Related U.S. Application Data

(60) Provisional application No. 60/382,638, filed on May 22, 2002.

(30) Foreign Application Priority Data

Apr. 26, 2002 (EP) ..... 02100421

(51) Int. Cl.
*B41N 1/08* (2006.01)

(52) U.S. Cl. ..... 101/459; 101/467

(58) Field of Classification Search ..... 101/453, 101/454, 457, 458, 459, 466, 467; 430/302
See application file for complete search history.

(56) References Cited

U.S. PATENT DOCUMENTS 5,061,591 A 10/1991 Nakanishi et al.
5,674,804 A * 10/1997 Steen et al. ..... 503/227
5,807,659 A * 9/1998 Nishimiya et al. ..... 430/302
6,071,369 A * 6/2000 Vermeersch et al. ..... 156/272.8
6,352,812 B1 * 3/2002 Shimazu et al. ..... 430/273.1
2002/0007751 A1 * 1/2002 Inoue et al. ..... 101/453
2002/0033108 A1 * 3/2002 Akiyama et al. ..... 101/457
2002/0172889 A1 * 11/2002 Oohashi ..... 430/273.1
2002/0182538 A1 * 12/2002 Tomita et al. ..... 430/278.1
2003/0082474 A1 * 5/2003 Haley et al. ..... 430/147

FOREIGN PATENT DOCUMENTS

EP 0 908 784 A1 4/1999
EP 931 647 * 7/1999
EP 0 976 550 A1 2/2000
EP 1 048 458 A1 11/2000
EP 1 160 083 A2 12/2001
JP 07-068966 A2 3/1955
JP 07-089041 A2 4/1955
JP 2002-96573 * 4/2002

OTHER PUBLICATIONS

Translation of JP 2002–96573.*

* cited by examiner

*Primary Examiner*—Stephen R. Funk
(74) *Attorney, Agent, or Firm*—Leydig, Voit & Mayer, Ltd.

(57) ABSTRACT

A negative-working lithographic printing plate precursor is disclosed which comprises a grained and anodized aluminum support having a hydrophilic surface and a heat-sensitive coating provided on the hydrophilic surface, the coating comprising hydrophobic thermoplastic polymer particles which are capable of forming a hydrophobic phase in the coating by heat-induced coalescence of the polymer particles. The support is characterized by a surface roughness, expressed as arithmetical mean center-line roughness Ra, which is less than 0.45 $\mu$m. The smooth surface enables to prepare a lithographic printing plate from the mentioned precursor, which is characterized by a high run length during printing.

15 Claims, No Drawings

NEGATIVE-WORKING THERMAL LITHOGRAPHIC PRINTING PLATE PRECURSOR COMPRISING A SMOOTH ALUMINUM SUPPORT

This application claims the benefit of U.S. Provisional Patent Application No. 60/382,638, filed May 22, 2002, which is hereby incorporated by reference.

FIELD OF THE INVENTION

The present invention relates to a negative-working non-ablative, thermal lithographic printing plate precursor which comprises a grained and anodized aluminum support characterized by a low surface roughness, as well as to methods for making a lithographic printing plate and methods of lithographic printing wherein said precursor is used.

BACKGROUND OF THE INVENTION

In lithographic printing, a so-called printing master such as a printing plate is mounted on a cylinder of the printing press. The master carries a lithographic image on its surface and a printed copy is obtained by applying ink to said image and then transferring the ink from the master onto a receiver material, which is typically paper. In conventional, so-called "wet" lithographic printing, ink as well as an aqueous fountain solution (also called dampening liquid) are supplied to the lithographic image which consists of oleophilic (or hydrophobic, i.e. ink-accepting, water-repelling) areas as well as hydrophilic (or oleophobic, i.e. water-accepting, ink-repelling) areas. In so-called "driographic" printing, the lithographic image consists of ink-accepting and ink-abhesive (ink-repelling) areas and during driographic printing, only ink is supplied to the master.

Printing masters are generally obtained by the so-called computer-to-film (CtF) method wherein various pre-press steps such as typeface selection, scanning, color separation, screening, trapping, layout and imposition are accomplished digitally and each color selection is transferred to graphic arts film using an image-setter. After processing, the film can be used as a mask for the exposure of an imaging material called plate precursor and after plate processing, a printing plate is obtained which can be used as a master. Since about 1995, the so-called 'computer-to-plate' (CtP) method has gained a lot of interest. This method, also called 'direct-to-plate', bypasses the creation of film because the digital document is transferred directly to a plate precursor by means of a so-called plate-setter.

Especially thermal plates, which are sensitive to heat or infrared light, are widely used in CtP methods because of their daylight stability. Such thermal materials may be exposed directly to heat, e.g. by means of a thermal head, but preferably comprise a compound that converts absorbed light into heat and are therefore suitable for exposure by lasers, especially infrared laser diodes. The heat, which is generated on image-wise exposure, triggers a (physico-) chemical process, such as ablation, polymerization, insolubilization by cross-linking of a polymer, decomposition, or particle coagulation of a thermoplastic polymer latex, and after optional processing, a lithographic image is obtained. Many thermal plate materials are based on heat-induced ablation. A problem associated with ablative plates is the generation of debris which is difficult to remove and may disturb the printing process or may contaminate the exposure optics of the plate-setter. As a result, such ablative plates require a processing step for removing the debris from the exposed material.

EP-A 770 494 discloses a method wherein an imaging material comprising an image-recording layer of a hydrophilic binder, a compound capable of converting light to heat and hydrophobic thermoplastic polymer particles, is image-wise exposed, thereby inducing coalescence of the polymer particles and converting the exposed areas into an hydrophobic phase which defines the printing areas of the printing master. The press run can be started immediately after exposure without any additional treatment because the layer is developed by interaction with the fountain and ink that are supplied to the cylinder during the press run. During the first ten or twenty revolutions of the press, the non-exposed areas are removed from the support and thereby define the non-printing areas of the plate. So the wet chemical processing of these materials is 'hidden' to the user and accomplished during the start-up of the printing press. Other prior art documents such as EP-A 770 497 and U.S. Pat. No. 6,001,536 describe the (off-press) development of similar materials with water or an aqueous liquid.

Until now, heat-induced polymer particle coalescence is the only heat-triggered non-ablative imaging mechanism that requires no separate processing step with alkaline chemicals and that meets all the requirements for making a high-quality printing plate material (Agfa Thermolite®). Various improvements of such materials are described in e.g. EP-As 773 112; 774 364; 802 457; 816 070; 849 090; 849 091; 881 095; and 931 647. However, none of the prior art materials, which work according to heat-induced polymer particle coalescence, is suitable for making printing plates that provide a high run length during printing. Degradation of the print quality due to image wear limits the run length to a maximum of typically 25,000 printed copies. Also the limited mechanical robustness (scratch sensitivity) and chemical resistance towards press chemicals such as plate cleaners, blanket cleaners and fountain additives contribute to the mentioned low printing endurance of such plates.

SUMMARY OF THE INVENTION

It is an object of the present invention to provide a non-ablative thermal printing plate precursor which does not require a separate processing step with alkaline chemicals and which provides a high run length and meets the many other requirements of a lithographic printing plate material. This object is realized by applying the heat-sensitive coating onto a smooth aluminum support. The effect that a smooth aluminum support provides a higher run length for a plate working according to heat-induced coalescence of hydrophobic thermoplastic polymer particles is quite surprising: the reason why a smooth surface, characterized by an arithmetical mean center-line roughness Ra, which is less than 0.45 $\mu$m, provides a significant reduction of the image wear during printing is not well understood; the skilled person would expect that a rough surface provides a better adherence to the coalesced polymer particles than a smooth surface. Nevertheless, the contrary is observed and materials comprising a smooth support with Ra value as defined herein unexpectedly provide the higher run length.

The preferred materials of the present invention are capable of providing a lithographic printing master that can be used for a press run of at least 30,000 and more preferably at least 60,000 copies without visible wear of the image. The best embodiments even enable a press run of more than 100,000 copies.

Specific features for preferred embodiments of the present invention are set out in the dependent claims. Further advantages and embodiments of the present invention will become apparent from the following description.

DETAILED DESCRIPTION OF THE INVENTION

The support of the plate precursor of the present invention is a grained and anodized aluminum support having a hydrophilic surface that is characterized by a low surface roughness, expressed as arithmetical mean center-line roughness (Ra), sometimes also referred to as CLA (center-line average). Ra as used herein is defined in ISO 4287/1 (=DIN 4762) and references therein. Ra values reported herein have been measured according to ISO 4288 and references therein by a mechanical profile method using a contact stylus with a very thin tip (also optical profile methods are known; such optical methods systematically provide higher values than the ISO method). The apparatus used for measuring Ra was a Talysurf 10 from Taylor Hobson Ltd.

The Ra value of the hydrophilic surface of the grained and anodized aluminum support used in the material of the present invention is lower than 0.45 $\mu$m, preferably lower than 0.4 $\mu$m and even more preferably lower than 0.3 $\mu$m. A grained and anodized aluminum support having a hydrophilic surface characterized by the mentioned low Ra values is briefly referred to herein as a "smooth support". The lower limit of the Ra value may be 0.05 $\mu$m, preferably 0.1 $\mu$m.

Graining and anodizing of aluminum lithographic supports is well known. The grained aluminum support used in the material of the present invention is preferably an electrochemically grained support. The acid used for graining can be e.g. nitric acid. The acid used for graining preferably comprises hydrogen chloride. Also mixtures of e.g. hydrogen chloride and acetic acid can be used.

The relation between electrochemical graining and anodizing parameters such as electrode voltage, nature and concentration of the acid electrolyte or power consumption on the one hand and the obtained lithographic quality in terms of Ra and anodic weight (g/m$^2$ of $Al_2O_3$ formed on the aluminum surface) on the other hand is well known. More details about the relation between various production parameters and Ra or anodic weight can be found in e.g. the article "Management of Change in the Aluminium Printing Industry" by F. R. Mayers, to be published in the ATB Metallurgie Journal. So the skilled person is well aware of the settings of the various parameters which are required for making a smooth surface on a grained aluminum support or for making a given anodic weight during aluminum anodization. According to the present invention, even higher run lengths can be obtained for a given roughness Ra by forming more than 2.5 g/m$^2$ of aluminum oxide at the hydrophilic surface, a value above 3.0 or even 3.5 g/m$^2$ being even more preferred.

The grained and anodized aluminum support may be post-treated to improve the hydrophilic properties of its surface. For example, the aluminum support may be silicated by treating its surface with a sodium silicate solution at elevated temperature, e.g. 95° C. Alternatively, a phosphate treatment may be applied which involves treating the aluminum oxide surface with a phosphate solution that may further contain an inorganic fluoride. Further, the aluminum oxide surface may be rinsed with an organic acid and/or salt thereof, e.g. carboxylic acids, hydroxycarboxylic acids, sulfonic acids or phosphonic acids, or their salts, e.g. succinates, phosphates, phosphonates, sulfates, and sulfonates. A citric acid or citrate solution is preferred. This treatment may be carried out at room temperature or may be carried out at a slightly elevated temperature of about 30 to 50° C. A further post-treatment involves rinsing the aluminum oxide surface with a bicarbonate solution. Still further, the aluminum oxide surface may be treated with polyvinylphosphonic acid, polyvinylmethylphosphonic acid, phosphoric acid esters of polyvinyl alcohol, polyvinylsulfonic acid, polyvinylbenzenesulfonic acid, sulfuric acid esters of polyvinyl alcohol, and acetals of polyvinyl alcohols formed by reaction with a sulfonated aliphatic aldehyde. It is further evident that one or more of these post-treatments may be carried out alone or in combination. More detailed descriptions of these treatments are given in GB-A-1 084 070, DE-A-4 423 140, DE-A-4 417 907, EP-A-659 909, EP-A-537 633, DE-A-4 001 466, EP-A-292 801, EP-A-291 760 and U.S. Pat. No. 4,458,005.

The coating provided on the support is heat-sensitive, thereby providing a plate precursor which can be handled in normal working lighting conditions (daylight, fluorescent light) for many hours. The coating comprises an image-recording layer which contains hydrophobic thermoplastic polymer particles. Specific examples of suitable hydrophobic polymers are e.g. polyethylene, poly(vinyl chloride), poly(methyl (meth)acrylate), poly(ethyl (meth)acrylate), poly(vinylidene chloride), poly(meth)acrylonitrile, poly (vinyl carbazole), polystyrene or copolymers thereof. According to preferred embodiments, the thermoplastic polymer comprises at least 50 wt. % of polystyrene, and more preferably at least 60 wt. % of polystyrene. In order to obtain sufficient resistivity against mechanical damage and towards press chemicals, such as the hydrocarbons used in plate cleaners, the thermoplastic polymer preferably comprises at least 5 wt. %, more preferably at least 30 wt. % of nitrogen containing monomeric units or of units which correspond to monomers that are characterized by a solubility parameter larger than 20, such as (meth)acrylonitrile or monomeric units comprising sulfonamide and/or phthalimide pendant groups. Other suitable examples of such nitrogen containing monomeric units are disclosed in European Patent Application no. 01000657, filed on Nov. 23, 2001. A specific embodiment of the hydrophobic thermoplastic polymer is a homopolymer or a copolymer of (meth) acrylonitrile and/or styrene, e.g. a copolymer consisting of styrene and acrylonitrile units in a weight ratio between 1:1 and 5:1 (styrene:acrylonitrile). A 2:1 or 3:2 ratio provides excellent results.

The weight average molecular weight of the thermoplastic polymer particles may range from 5,000 to 1,000,000 g/mol. The hydrophobic particles preferably have a number average particle diameter below 200 nm, more preferably between 10 and 100 nm. The amount of hydrophobic thermoplastic polymer particles contained in the image-recording layer is preferably between 20 wt. % and 65 wt. % and more preferably between 25 wt. % and 55 wt. % and most preferably between 30 wt. % and 45 wt. %.

The hydrophobic thermoplastic polymer particles can be provided as a dispersion in an aqueous coating liquid of the image-recording layer and may be prepared by the methods disclosed in U.S. Pat. No. 3,476,937. Another method especially suitable for preparing an aqueous dispersion of the thermoplastic polymer particles comprises:

dissolving the hydrophobic thermoplastic polymer in an organic water immiscible solvent, dispersing the thus obtained solution in water or in an aqueous medium and removing the organic solvent by evaporation.

The image-recording layer further may comprise a hydrophilic binder, e.g. homopolymers and copolymers of vinyl alcohol, acrylamide, methylol acrylamide, methylol methacrylamide, acrylic acid, methacrylic acid, hydroxyethyl acrylate, hydroxyethyl methacrylate or maleic anhydride/vinylmethylether copolymers. The hydrophilicity of the (co)polymer or (co)polymer mixture used is preferably the same as or higher than the hydrophilicity of polyvinyl acetate hydrolyzed to at least an extent of 60 percent by weight, preferably 80 percent by weight. Binders with carboxylic pendant groups, e.g. poly(meth)acrylic acid, are preferred.

The image-recording layer may also contain other ingredients such as additional binders, surfactants, colorants, development inhibitors or accelerators, and especially one or more compounds that are capable of converting infrared light into heat. Particularly useful light-to-heat converting compounds are for example infrared dyes, carbon black, metal carbides, borides, nitrides, carbonitrides, bronze-structured oxides, and conductive polymer dispersions such as polypyrrole, polyaniline or polythiophene dispersions. Anionic cyanine dyes are preferred. The colorants are preferably dyes or pigments which provide a visible image after processing.

The coating may also contain one or more additional layer(s), adjacent to the image-recording layer. Such additional layer can e.g. be an adhesion-improving layer between the image-recording layer and the support; or a light-absorbing layer comprising one or more of the above compounds that are capable of converting infrared light into heat; or a covering layer which is removed during processing.

The materials of the present invention are suitable for off-press and on-press exposure. The printing plate precursors of the present invention are exposed to heat or to infrared light, e.g. by means of a thermal head, LEDs or an infrared laser. Preferably, a laser emitting near infrared light having a wavelength in the range from about 700 to about 1500 nm is used, e.g. a semiconductor laser diode, a Nd:YAG or a Nd:YLF laser. The required laser power depends on the sensitivity of the image-recording layer, the pixel dwell time of the laser beam, which is determined by the spot diameter (typical value of modern plate-setters at $1/e^2$ of maximum intensity: 10–25 $\mu$m), the scan speed and the resolution of the exposure apparatus (i.e. the number of addressable pixels per unit of linear distance, often expressed in dots per inch or dpi; typical value: 1000–4000 dpi). Two types of laser-exposure apparatuses are commonly used: internal (ITD) and external drum (XTD) plate-setters. ITD plate-setters for thermal plates are typically characterized by a very high scan speed up to 500 m/sec and may require a laser power of several Watts. XTD plate-setters for thermal plates having a typical laser power from about 200 mW to about 1 W operate at a lower scan speed, e.g. from 0.1 to 10 m/sec.

Due to the heat generated during the exposure step, the hydrophobic thermoplastic polymer particles fuse or coagulate so as to form a hydrophobic phase which corresponds to the printing areas of the printing plate. Coagulation may result from heat-induced coalescence, softening or melting of the thermoplastic polymer particles. There is no specific upper limit to the coagulation temperature of the thermoplastic hydrophobic polymer particles, however the temperature should be sufficiently below the decomposition temperature of the polymer particles. Preferably the coagulation temperature is at least 10° C. below the temperature at which the decomposition of the polymer particles occurs. The coagulation temperature is preferably higher than 50° C., more preferably above 100° C.

After exposure, the material is developed. "Developing" and "processing" are used herein as equivalent terms. Development can be carried out by supplying to the coating a liquid comprising a hydrophilic phase, thereby removing the coating from the support at non-exposed areas. Said liquid can be selected from the group consisting of water, an aqueous liquid, gum, fountain and single-fluid ink. According to one embodiment, the material is developed by supplying fountain and/or printing ink, preferably by supplying first fountain and subsequently ink. This method is preferably used in combination with an on-press exposure step. Another development method, also suitable for on-press development, especially in driographic presses, is performed by supplying single-fluid ink. Single-fluid inks which are suitable for use in the method of the present invention have been described in U.S. Pat No. 4,045,232 and U.S. Pat. No. 4,981,517. A suitable single-fluid ink comprises an ink phase, also called the hydrophobic or oleophilic phase, and a polyol phase as described in WO 00/32705. More information on the development with single-fluid ink can be found in EP-A no. 01000633, filed on Nov. 11, 2001.

When exposed in an off-press plate-setter, the material can be processed on-press by supplying ink and/or fountain as mentioned before or off-press, e.g. by supplying water, an aqueous liquid or a gum solution. A gum solution is typically an aqueous liquid which comprises one or more surface protective compounds that are capable of protecting the lithographic image of a printing plate against contamination or damaging. Suitable examples of such compounds are film-forming hydrophilic polymers or surfactants. More information on the development with a gum solution can be found in EP-A no. 02100226, filed on Jun. 3, 2002.

After development, the plate can be dried and baked. The plate can be dried before baking or is dried during the baking process itself. The baking process can proceed at a temperature above the coagulation temperature of the thermoplastic polymer particles, e.g. between 100° C. and 230° C. for a period of 5 to 40 minutes. For example the exposed and developed plates can be baked at a temperature of 230° C. for 5 minutes, at a temperature of 150° C. for 10 minutes or at a temperature of 120° C. for 30 minutes. A preferred baking temperature is above 60° C. Baking can be done in conventional hot air ovens or by irradiation with lamps emitting in the infrared or ultraviolet spectrum.

EXAMPLES

In the Examples below, run length is defined as the number of copies printed when the degradation, due to image wear, of a 60% screen of a high quality image (200 1 pi) exceeds 5%. Unless indicated otherwise, all the plates described below were on-press processed by the ink-and fountain supplied to the plate during the first ten to fifteen revolutions of the press.

Example 1 (Comparative) and 2 (Invention)

Preparation of the Lithographic Support 1

A 0.30 mm thick aluminum foil was degreased by immersing the foil in an aqueous solution containing 40 g/l of sodium hydroxide at 60° C. for 8 seconds and rinsed with demineralized water for 2 seconds. The foil was then electrochemically grained during 15 seconds using an alternating current in an aqueous solution containing 12 g/l of hydrochloric acid and 38 g/l of aluminum sulfate (18-hydrate) at a temperature of 33° C. and a current density of 130 A/dm$^2$. After rinsing with demineralized water for 2 seconds, the aluminum foil was then desmutted by etching with an aqueous solution containing 155 g/l of sulfuric acid at 70° C. for 4 seconds and rinsed with demineralized water at 25° C. for 2 seconds. The foil was subsequently subjected to anodic oxidation during 13 seconds in an aqueous solution containing 155 g/l of sulfuric acid at a temperature of 45° C. and a current density of 22 A/dm$^2$, then washed with demineralized water for 2 seconds and post-treated for 10 seconds with a solution containing 4 g/l of polyvinylphosphonic acid at 40° C., rinsed with demineralized water at 20° C. during 2 seconds and dried.

The support thus obtained was characterized by a surface roughness Ra of 0.46 $\mu$m and had an anodic weight of 2.9 g/m$^2$ of $Al_2O_3$.

Preparation of the Lithographic Support 2

The same procedure as above was followed with the proviso that the current density during graining and anodizing was 90 A/dm$^2$ and 30 A/dm$^2$ respectively. The support thus obtained was characterized by a surface roughness Ra of 0.22 $\mu$m and had an anodic weight of 4.0 g/m$^2$ of $Al_2O_3$.

Preparation and Test of Printing Plates 1 and 2

A comparative printing plate precursor 1 and printing plate precursor 2 according to the invention were produced by preparing a coating composition and coating it onto the above described lithographic supports 1 and 2 respectively.

Onto the above described lithographic supports an image-recording layer was coated from an aqueous coating solution at a wet thickness of 30 g/m$^2$. After drying, the layer consisted of 600 mg/m$^2$ of a copolymer of styrene and acrylonitrile (weight ratio 60/40) having an average particle size of 65 nm, stabilized with an anionic wetting agent, 60 mg/m$^2$ of infrared absorbing dye I and 120 mg/m$^2$ of polyacrylic acid (Glascol D15 from Allied Colloids, molecular weight 2.7×10$^7$ g/mole).

Dye 1

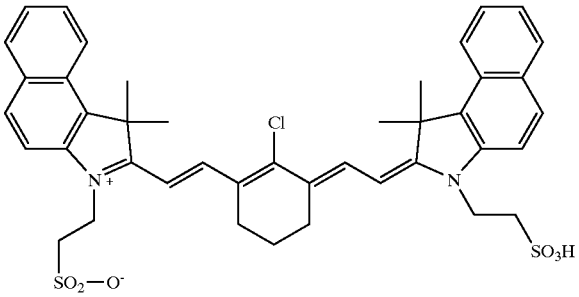

The plate precursors thus obtained were exposed with a Creo Trendsetter (plate-setter available from Creo, Burnaby, Canada), operating at 330 mJ/cm$^2$ and 150 rpm. After imaging, the plates were mounted on a MO printing press (available from Heidelberger Druckmaschinen AG), and a print job was started using K+E800 ink and 4% Combifix XL with 10% isopropanol as a fountain liquid.

After 25,000 prints, degradation of the image started in the plate obtained from printing plate precursor 1 and after a run length of 30,000 prints, the image wear exceeded the criterion defined above. The plate obtained with printing plate precursor 2 did not show any wear at all, not even after 100,000 impressions when the press run was stopped.

Example 3 (Invention) and 4 (Comparative)

Preparation of the Lithographic Support 3

A continuous web of aluminum having a thickness of 0.30 mm and a width of 500 mm was degreased by immersing the web in an aqueous solution containing 10.4 g/l of sodium hydroxide at 38° C. for 35 seconds and then rinsing with demineralized water for 30 seconds. The aluminum web was then electrochemically grained for 30 seconds using an alternating current at a current density of 826 A/m$^2$ in a mixed acid aqueous solution containing 9.5 g/l of hydrochloric acid and 21 g/l of acetic acid at a temperature of 29° C. The support thus obtained had an average center-line roughness Ra of 0.24 $\mu$m. After rinsing with demineralized water for 30 seconds, the aluminum web was etched to remove smut with an aqueous solution containing 124 g/l of phosphoric acid at 43° C. for 35 seconds and then rinsed with demineralized water for 30 seconds. The aluminum web was subsequently subjected to anodic oxidation for 30 seconds in an aqueous solution containing 137 g/l of sulfuric acid at a temperature of 48.5° C., using a DC voltage at a current density of 1173 A/m$^2$ to form an anodic oxidation film of 3.4 g/m$^2$ of $Al_2O_3$, then washed with demineralized water for 30 seconds and post-treated for 15 seconds with a solution containing 2.2 g/l of polyvinylphosphonic acid at 52° C., rinsed with demineralized water for 30 seconds and dried.

Preparation of the Lithographic Support 4

The same procedure as for support 3 was followed with the proviso that the current density during graining was 2125 A/dm$^2$. The support thus obtained was characterized by a surface roughness Ra of 0.53 $\mu$m. The anodic weight was the same as for support 3.

Preparation and Test of Printing Plates 3 and 4

Printing plate precursors 3 and 4 were prepared by coating the same composition as described above for the preparation of printing plate precursor 1 and 2. Also the exposure, on-press processing and printing procedure was the same.

Plate 4 showed a run length of 30,000 copies while plate 3 did not show any image wear after 50,000 copies, when the run length tests was stopped.

Examples 5–9

Preparation of Lithographic Supports 5–9

A continuous web of aluminum having a thickness of 0.30 mm and a width of 500 mm was degreased by immersing the web in an aqueous solution containing 10 g/l of sodium hydroxide at 39° C. for 35 seconds and then rinsing with demineralized water for 30 seconds. The aluminum web was then electrochemically grained for 30 seconds using an alternating current at a current density as indicated in Table 1 in a mixed acid aqueous solution containing 8.1 g/l of hydrochloric acid and 21.7 g/l of acetic acid at a temperature of 30° C. After rinsing with demineralized water for 30 seconds, the aluminum web was etched to remove smut with an aqueous solution containing 128 g/l of phosphoric acid at 43° C. for 35 seconds and then rinsed with demineralized water for 30 seconds. The aluminum web was subsequently subjected to anodic oxidation for 30 seconds in an aqueous solution containing 154 g/l of sulfuric acid at a temperature of 50° C., using a DC voltage at a current density as indicated in Table 1, then washed with demineralized water for 30 seconds and post-treated for 15 seconds with a solution containing 2.45 g/l of polyvinylphosphonic acid at 53° C., rinsed with demineralized water for 30 seconds and dried.

Preparation and Test of Printing Plates 5–9

Printing plate precursors 5–9 were prepared by coating the same composition as described above for the preparation of printing plate precursor 1 and 2 onto the supports 5–9 respectively. Also the exposure, on-press processing and printing procedure was the same.

Table 1 gives the current densities for graining (GR) and anodizing (AN), surface roughness Ra and the anodic weight (AW) of lithographic supports 5–9 and the run length achieved with plates 5–9.

TABLE 1

| Example no. | current GR ($A/m^2$) | Ra ($\mu$m) | current AN ($A/m^2$) | AW ($g/m^2$) | Run length |
|---|---|---|---|---|---|
| 5 (comp.) | 2740 | 0.53 | 2350 | 4.8 | 11 000 |
| 6 (inv.) | 1300 | 0.28 | 2350 | 4.8 | 55 000 |
| 7 (inv.) | 1300 | 0.28 | 1750 | 3.5 | 50 000 |
| 8 (inv.) | 1300 | 0.28 | 2900 | 6.3 | 70 000 |
| 9 (inv.) | 1000 | 0.21 | 2350 | 4.8 | >90 000 |

The data for Example 5, 6 and 9 in the above table demonstrate that for a given anodic weight (4.8 $g/m^2$), the run length significantly improves by reducing Ra. For a given Ra value (Examples 6–8: 0.28 $\mu$m), a further improvement is achieved by increasing the anodic weight. Plate 9 still showed no image wear after 90,000 copies when the press run was stopped.

Examples 10–12

Preparation of Printing Plate Precursor 10–11

The same lithographic support and coating was used as in Example 1 and 2 respectively with the proviso that the thermoplastic polymer was a homopolymer of styrene having an average particle size of 70 nm.

Preparation and Test of Printing Plates 10–12

Plates 10 and 11 were prepared from precursors 10 and 11 respectively by exposure and processing as described in the previous examples with the proviso that the on-press processing and run length test was preformed on a GTO printing press (Heidelberger Druckmaschinen), using K+E800 ink and 4% Combifix XL with 10% Isopropanol as a fountain liquid. Plate 12 was prepared from precursor 2 using the same procedure as for plates 10 and 11.

TABLE 2

| Example no. | Ra ($\mu$m) | Polymer | Run length |
|---|---|---|---|
| 10 (comp.) | 0.46 | styrene homopolymer | 21 500 |
| 11 (inv.) | 0.22 | styrene homopolymer | 85 000 |
| 12 (inv.) | 0.22 | styrene/acrylo-nitrile copolymer | >100 000 |

The above data demonstrate that a further run length improvement is obtained by introducing a nitrogen-containing unit such as acrylonitrile into the hydrophobic thermoplastic polymer.

Examples 13–15

Chemical Resistance Test of Printing Plates 10–12

Plates 10–12, prepared as described above, were subjected to three chemical resistance tests.

Test 1: The image-wise exposed plates were mounted on a GTO printing press (Heidelberger Druckmaschinen) and a press run of 500 copies was started using K+E800 ink and 4% Combifix XL with 10% Isopropanol as a fountain liquid. Then a printing area of each plate was treated with two typical press liquids (Meter–X=roller wash liquid from ABC Chemicals Comp. Ltd., UK, based on hydrocarbons; Normakleen=plate cleaner from Agfa, based on a petroleum distillate) using a cotton pad dipped into the corresponding liquid and rubbing over the surface; the damage of the treated areas was evaluated (see Table 3: 0=no image attack; X=strong image attack; XX=image completely removed).

TABLE 3

| Plate no. | Ra ($\mu$m) | Polymer | Image attack Meter-X | Image attack Normakleen |
|---|---|---|---|---|
| 10 (comp.) | 0.46 | styrene homopolymer | XX | XX |
| 11 (inv.) | 0.22 | styrene homopolymer | XX | XX |
| 12 (inv.) | 0.22 | styrene/acrylo-nitrile copolymer | 0 | 0 |

Test 2: The image-wise exposed plates were mounted on a GTO printing press (Heidelberger Druckmaschinen) and a press run of 500 copies was started using K+E800 ink and 4% Combifix XL with 10% Isopropanol as a fountain liquid. Then a drop of each of the same liquids as used in Test 1 was put onto a printing area of the plates and allowed to dry for 4 minutes. Then, printing was started again for another 200 copies (the rubbing of test 1 is replaced by printing in test 2). After the second press run, the areas treated with the liquid were evaluated (see Table 4: 0=no image attack; X=strong image attack; XX=image completely removed).

TABLE 4

| Plate no. | Ra ($\mu$m) | Polymer | Image attack Meter-X | Image attack Normakleen |
|---|---|---|---|---|
| 10 (comp.) | 0.46 | styrene homopolymer | XX | X |
| 11 (inv.) | 0.22 | styrene homopolymer | XX | X |
| 12 (inv.) | 0.22 | styrene/acrylo-nitrile copolymer | 0 | 0 |

Test 3: The coating of the image-wise exposed plates was mechanically scratched in a non-exposed area. Then the plates were mounted on a press as described in test 1 and 2 and 1000 copies were printed. The press was stopped and it was evaluated whether the scratch was visible on the last printed copies (inking up in non-image parts due to scratching)

TABLE 5

| Plate no. | Ra ($\mu$m) | Polymer | Scratches |
|---|---|---|---|
| 10 (comp.) | 0.46 | styrene homopolymer | severe |
| 11 (inv.) | 0.22 | styrene homopolymer | small |
| 12 (inv.) | 0.22 | styrene/acrylo-nitrile copolymer | none |

Examples 16 and 17

Preparation of Lithographic Support 16

All the steps were identical to Example 2 except for the graining step: the aluminum foil was electrochemically grained during 4 seconds in an aqueous solution containing 12.4 g/l of nitric acid and 67 g/l of aluminum nitrate (9-hydrate) at a temperature of 40° C., using an alternating current at a current density of 36 $A/dm^2$ The Ra value of the nitric acid grained support thus obtained was 0.38 $\mu$m.

Preparation and Test of Printing Plates 16 and 17.

Printing plate precursor 16 was prepared by coating the same composition as described in Example 2 on the above support 16. Plates 16 and 17 were prepared by exposing plate precursors 16 and 2 respectively with a Creo Trendsetter (plate-setter available from Creo, Burnaby, Canada), operating at 330 $mJ/cm^2$ and 150 rpm. After imaging the plates 16 and 17 was mounted on a MO printing press (available from Heidelberger Druckmaschinen AG), and printing was started using K+E800 ink and 4% Combifix XL with 10% Isopropanol as a fountain liquid. Similar samples of plates 16 and 17 were mounted on a Speedmaster 74 printing press (SM-74, available from Heidelberger Druckmaschinen AG) and printing was started using K+E700 Novavit Speed ink and 4% Varnfount as a fountain liquid.

TABLE 6

| Plate no. | acid used for graining | printing press | ink built-up on blanket |
|---|---|---|---|
| 16 (inv.) | chloric acid | MO | no |
| 17 (inv.) | nitric acid | MO | no |
| 16 (inv.) | chloric acid | SM-74 | no |
| 17 (inv.) | nitric acid | SM-74 | yes |

None of the plates showed image wear during the press run of 100,000 copies. Plate 17 (nitric acid graining) showed ink built-up on the blanket of the SM-74 during printing while plate 16 (chloric acid graining) was running on the SM-74 without any ink built up on the blanket throughout the whole press run.

Examples 18 and 19

Plate 18 was prepared as described in Example 2 with the proviso that the exposed plate was off-press processed with a gum solution using RC520 baking gum from Agfa (HWP450 processor, 1 minute immersion time, room temperature).

Plate 19 was prepared similarly, but after processing the plate was baked during 2 minutes at 270° C.

Both plates were evaluated on a MO printing press (Heidelberger Druckmaschinen AG) using K+E800 ink and 4% Combifix XL with 10% Isopropanol as a fountain liquid.

After 150,000 impressions, degradation of the image started with unbaked plate 18 while the baked plate 19 showed no image wear at all. Even after 300,000 impressions no image wear was observed with plate 19 and the run length test was stopped.

We claim:

1. A negative-working lithographic priming plate precursor comprising a grained and anodized aluminum support having a hydrophilic surface;

a heat-sensitive coating provided on the hydrophilic surface, said coating consisting essentially of hydrophobic thermoplastic polymer particles which are capable of forming a hydrophobic phase in said coating by heat-induced coalescence of said polymer particles and an anionic infrared light absorbing cyanine dye; and optionally one or more of binders, surfactants, colorants, development inhibitors or accelerators, and light-to-heat converting compounds;

wherein the hydrophilic surfacc has a surface roughness, expressed as arithmetical mean center-line rougbness Ra, which is less than 0.45 $\mu$m, and the aluminum support comprises more than 2.5 g/m$^2$ of aluminum oxide at the hydrophilic surface.

2. A plate precursor according to claim 1 wherein the hydrophilic surface has a surface roughness, expressed as arithmetical mean center-line roughness Ra, which is less than 0.4 $\mu$m.

3. A plate precursor according to claim 1 wherein the hydrophilic surface has a surface roughness, expressed as arithmetical mean center-line roughness Ra, which is less than 0.3 $\mu$m.

4. A plate precursor according to claim 1 wherein the aluminum support comprises more than 3.5 g/m$^2$ of aluminum oxide at the hydrophilic surface.

5. A plate precursor according to claim 1 wherein the hydrophobic thermoplastic polymer is a homopolymer or a copolymer of (meth)acrylonitrile and/or styrene.

6. A plate precursor according to claim 1 wherein the hydrophobic thermoplastic polymer comprises sulfonamide and/or phthalimide pendant groups.

7. A plate precursor according to claim 1 wherein the heat-sensitive coating further comprises a hydrophilic polymeric binder comprising carboxylic pendant groups.

8. A plate precursor according to claim 1 wherein the heat-sensitive coating further comprises a visible light absorbing dye or pigment.

9. A plate precursor according to claim 1 wherein the hydrophilic surface is hydrophilized by treatment with (i) an organic acid and/or a salt thereof or with (ii) a polymer selected from the group consisting of polyvinylphosphonic acid, polyvinylmethylphosphonic acid, phosphoric acid esters of polyvinyl alcohol, polyvinylsulfonic acid, polyvinylbenzenesulfonic acid, sulfuric acid esters of polyvinyl alcohol, and the product of the reaction of polyvinylalcohol with a sulfonated aliphatic aldehyde.

10. A method of making a lithographic printing plate comprising the steps of image-wise exposing a plate precursor according to claim 1 to heat or to infrared light, thereby inducing coalescence of the hydrophobic thermoplastic polymer particles at exposed areas;

developing the exposed plate precursor by supplying to the coating a liquid comprising a hydrophilic phase, thereby removing the coating from the support at non-exposed areas, said liquid being selected from the group consisting of water, an aqueous liquid, gum, fountain and single-fluid ink.

11. A method according to claim 10 wherein the steps of exposing and developing are performed while the plate precursor is mounted on a cylinder of a lithographic printing press.

12. A method according to claim 10 further comprising the step of subjecting the developed plate precursor to a baking treatment at a temperature above 60° C.

13. A method of lithographic printing comprising the steps of making a lithographic printing plate according to the method of claim 12;

printing at least 300,000 copies with the lithographic printing plate thus obtained.

14. A method of lithographic printing comprising the steps of making a lithographic printing plate according to the method of claim 10;

printing at least 60,000 copies with the lithographic printing plate thus obtained.

15. A method of lithographic printing comprising the steps of making a lithographic printing plate according to the method of claim 10;

printing at least 100,000 copies with the lithographic printing plate thus obtained.

* * * * *